US008983099B2

(12) United States Patent
Takano et al.

(10) Patent No.: US 8,983,099 B2
(45) Date of Patent: Mar. 17, 2015

(54) ELECTROSTATIC LOUDSPEAKER

(75) Inventors: Yasuaki Takano, Hamamatsu (JP); Kunimasa Muroi, Hamamatsu (JP); Yoshikatsu Matsubara, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 13/809,832

(22) PCT Filed: Jul. 12, 2011

(86) PCT No.: PCT/JP2011/065901
§ 371 (c)(1),
(2), (4) Date: Jan. 11, 2013

(87) PCT Pub. No.: WO2012/008458
PCT Pub. Date: Jan. 19, 2012

(65) Prior Publication Data

US 2013/0108087 A1 May 2, 2013

(30) Foreign Application Priority Data

Jul. 12, 2010 (JP) ..... 2010-158269

(51) Int. Cl.
*H04R 25/00* (2006.01)

(52) U.S. Cl.
USPC ..... 381/191; 381/174; 381/175

(58) Field of Classification Search
USPC ..... 381/152, 173–176, 189–191, 431
See application file for complete search history.

(56) References Cited

U.S. PATENT DOCUMENTS

| | | | | |
|---|---|---|---|---|
| 3,942,029 | A | 3/1976 | Kawakami et al. | |
| 5,392,358 | A * | 2/1995 | Driver | 381/191 |
| 6,175,636 | B1 | 1/2001 | Norris et al. | |
| 8,666,094 | B2 * | 3/2014 | Matsuzawa | 381/191 |
| 8,666,097 | B2 * | 3/2014 | Ichikawa et al. | 381/191 |
| 2006/0182293 | A1 | 8/2006 | Sekino et al. | |

(Continued)

FOREIGN PATENT DOCUMENTS

| | | | |
|---|---|---|---|
| CN | 1750716 | A | 3/2006 |
| JP | 48-048262 | U | 12/1974 |

(Continued)

OTHER PUBLICATIONS

Korean Office Action for corresponding KR 10-2013-7000838, mail date Jan. 27, 2014.

(Continued)

*Primary Examiner* — Suhan Ni
(74) *Attorney, Agent, or Firm* — Rossi, Kimms & McDowell LLP

(57) ABSTRACT

An electrostatic loudspeaker includes: a first electrode having acoustic transmission property; a second electrode having acoustic transmission property, and disposed so as to be opposed to the first electrode; a vibrating member having conductibility, and disposed between the first electrode and the second electrode; a first elastic member having elasticity, insulation property, and acoustic transmission property, and disposed between the vibrating member and the first electrode; a second elastic member having elasticity, insulation property, and acoustic transmission property, and disposed between the vibrating member and the second electrode; and a first separation member having insulation property and acoustic transmission property, and disposed on an opposite side of a face of the first electrode, which is opposed to the first elastic member.

19 Claims, 16 Drawing Sheets

(56) References Cited

U.S. PATENT DOCUMENTS

| | | | | |
|---|---|---|---|---|
| 2007/0154036 | A1 | 7/2007 | Matsuzawa | |
| 2007/0242843 | A1 | 10/2007 | Matsuzawa et al. | |
| 2007/0274545 | A1* | 11/2007 | Nakaya et al. | 381/191 |
| 2009/0034761 | A1* | 2/2009 | Nakaya et al. | 381/191 |
| 2009/0202088 | A1 | 8/2009 | Sekino et al. | |

FOREIGN PATENT DOCUMENTS

| | | | |
|---|---|---|---|
| JP | 50032919 | A | 3/1975 |
| JP | 49-155995 | U | 10/1976 |
| JP | 50-154921 | U | 10/1976 |
| JP | 04-157900 | A | 5/1992 |
| JP | 2006-86789 | A | 3/2006 |
| JP | 2007-318554 | A | 6/2007 |
| JP | 2007195150 | A | 8/2007 |
| JP | 2007-274343 | A | 10/2007 |
| JP | 2008-054154 | A | 3/2008 |
| JP | 2008236224 | A | 10/2008 |
| JP | 2009206758 | A | 9/2009 |
| JP | 2009-260876 | A | 11/2009 |
| JP | 2010-068053 | A | 3/2010 |

OTHER PUBLICATIONS

International Search Report issued in PCT/JP2011/065901 dated Aug. 16, 2011.

International Search Report issued in PCT/JP2011/065903 mailed Oct. 4, 2011. English translation provided.

Office Action issued in JP2011-088422 mailed Jul. 16, 2014. English Translation provided.

Official Action issued in U.S. Appl. No. 13/741,512 mailed Sep. 30, 2014.

* cited by examiner

ELECTROSTATIC LOUDSPEAKER

TECHNICAL FIELD

The present invention relates to an electrostatic loudspeaker.

BACKGROUND ART

The push-pull electrostatic loudspeaker disclosed in Patent Document 1 includes two flat electrodes opposed to each other with a clearance therebetween and a membranous vibrating plate (vibrating member) having conductibility and disposed between the flat electrodes; when a predetermined bias voltage is applied to the vibrating plate and the voltage to be applied across the flat electrodes is changed, the electrostatic force exerted to the vibrating plate is changed, whereby the vibrating plate is displaced. When the applied voltage is changed depending on an acoustic signal to be input, the vibrating plate is displaced repeatedly depending on the change, and an acoustic wave depending on the acoustic signal is generated from both faces of the vibrating plate. The generated acoustic wave passes through through-holes formed in the flat electrodes and is radiated to the outside.

Furthermore, as an electrostatic loudspeaker having flexibility and being foldable or bendable, the electrostatic loudspeaker disclosed in Patent Document 2 is available. In the electrostatic loudspeaker, a polyester film (vibrating member) on which aluminum is evaporated is held between two pieces of cloth (electrodes) woven with conductive threads, and ester wool is disposed between the film and the cloth.

PRIOR ART DOCUMENTS

Patent Documents

Patent Document 1: JP-A-2007-318554
Patent Document 2: JP-A-2008-54154

SUMMARY OF THE INVENTION

Problem that the Invention is to Solve

A push-pull electrostatic loudspeaker generates an acoustic wave from both faces of the vibrating plate (vibrating member) thereof. However, in the case that the push-pull electrostatic loudspeaker is installed so as to be made contact with a shield through which the acoustic wave hardly passes, such as a floor face or a wall face, the acoustic wave generated toward the shield is blocked by the shield, and there occurs a problem that the acoustic wave is not radiated to the outside of the electrostatic loudspeaker.

Under the circumstances described above, an object of the present invention is to provide a push-pull electrostatic loudspeaker capable of radiating the acoustic wave generated from both faces of the vibrating member thereof to the outside of the electrostatic loudspeaker even if the electrostatic loudspeaker is installed so as to be made contact with a shield through which the acoustic wave hardly passes.

Means for Solving the Problems

In order to solve the above problems, according to the invention, there is provided an electrostatic loudspeaker comprising: a first electrode having acoustic transmission property; a second electrode having acoustic transmission property, and disposed so as to be opposed to the first electrode; a vibrating member having conductibility, and disposed between the first electrode and the second electrode; a first elastic member having elasticity, insulation property, and acoustic transmission property, and disposed between the vibrating member and the first electrode; a second elastic member having elasticity, insulation property, and acoustic transmission property, and disposed between the vibrating member and the second electrode; and a first separation member having insulation property and acoustic transmission property, and disposed on an opposite side of a face of the first electrode, which is opposed to the first elastic member.

In the invention, the electrostatic loudspeaker may further include a second separation member having insulation property and acoustic transmission property, and disposed on an opposite side of a face of the second electrode, which is opposed to the second elastic member.

In the invention, the first separation member may have a hole opening from an inside of the first separation member toward a face on an opposite side of a face of the first separation member, which is opposed to the first electrode.

In the invention, a holding member may be inserted into the hole.

In the invention, the first separation member may have a hole in a circumferential face thereof.

In the invention, a hook member may be inserted into the hole.

In the invention, the first separation member may have elasticity.

In the invention, the first separation member may be integrated with a main body having at least the first electrode, the second electrode, the vibrating member, the first elastic member, and the second elastic member using a restraining member so as to be formed into one body.

In the invention, the restraining member may have a belt shape.

In the invention, the restraining member may be a member for covering the first separation member and the main body.

In the invention, the first separation member may have one face formed into a convex shape, and a main body having at least the first electrode, the second electrode, the vibrating member, the first elastic member, and the second elastic member may be provided on the one face.

In the invention, the first separation member may have one face formed into a concave shape, and a main body having at least the first electrode, the second electrode, the vibrating member, the first elastic member, and the second elastic member may be provided on the one face.

In the invention, the first separation member may have one face formed into a curved shape, and a main body having at least the first electrode, the second electrode, the vibrating member, the first elastic member, and the second elastic member may be provided on a face on an opposite side of the one face.

In the invention, the first separation member may have a base and a plurality of protrusions provided on one face of the base.

In the invention, the first separation member may be a member in which a plurality of spaces having a predetermined shape are joined together.

In the invention, the predetermined shape is a hexagonal shape.

In order to solve the above problems, according to the invention, there is provided a speaker system comprising: a loudspeaker's main body including: a first electrode having acoustic transmission property; a second electrode having acoustic transmission property, and disposed so as to be opposed to the first electrode; a vibrating member having conductibility, and disposed between the first electrode and the second electrode; a first elastic member having elasticity, insulation property, and acoustic transmission property, and disposed between the vibrating member and the first electrode; and a second elastic member having elasticity, insulation property, and acoustic transmission property, and disposed between the vibrating member and the second electrode; and a separation member having insulation property and acoustic transmission property, and disposed on an opposite side of a face of the first electrode of the loudspeaker's main body, which is opposed to the first elastic member.

In order to solve the above problems, according to the invention, there is provided a separation member mounted on a loudspeaker's main body having a first electrode having acoustic transmission property, a second electrode having acoustic transmission property, and disposed so as to be opposed to the first electrode, a vibrating member having conductibility, and disposed between the first electrode and the second electrode, a first elastic member having elasticity, insulation property, and acoustic transmission property, and disposed between the vibrating member and the first electrode, and a second elastic member having elasticity, insulation property, and acoustic transmission property, and disposed between the vibrating member and the second electrode, wherein the separation member has insulation property and acoustic transmission property and is disposed on an opposite side of a face of the first electrode of the loudspeaker's main body, which is opposed to the first elastic member.

Advantage of the Invention

The electrostatic loudspeaker according to the present invention can radiate the acoustic wave generated from both faces of the vibrating member thereof to the outside of the electrostatic loudspeaker even if the electrostatic loudspeaker is installed so as to be made contact with a shield through which the acoustic wave hardly passes.

MODE FOR CARRYING OUT THE INVENTION

[Embodiment]

Figure 1:
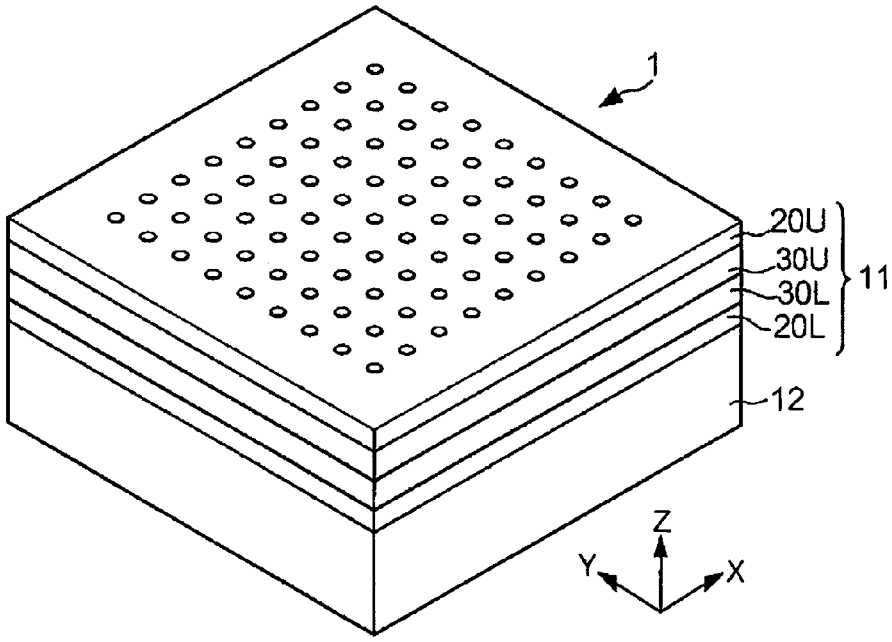
FIG. 1 is an external view showing an electrostatic loudspeaker according to an embodiment of the present invention.
Figure 2:
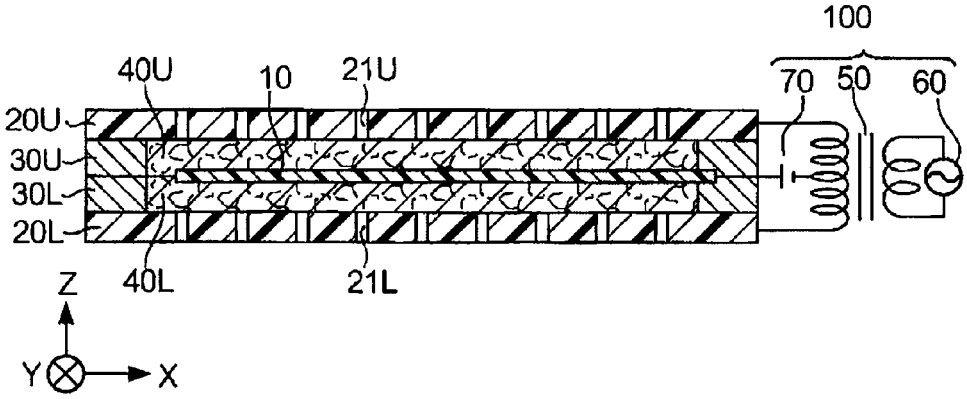
FIG. 2 is a schematic view showing the cross-section and electrical configuration of the electrostatic loudspeaker.
Figure 3:
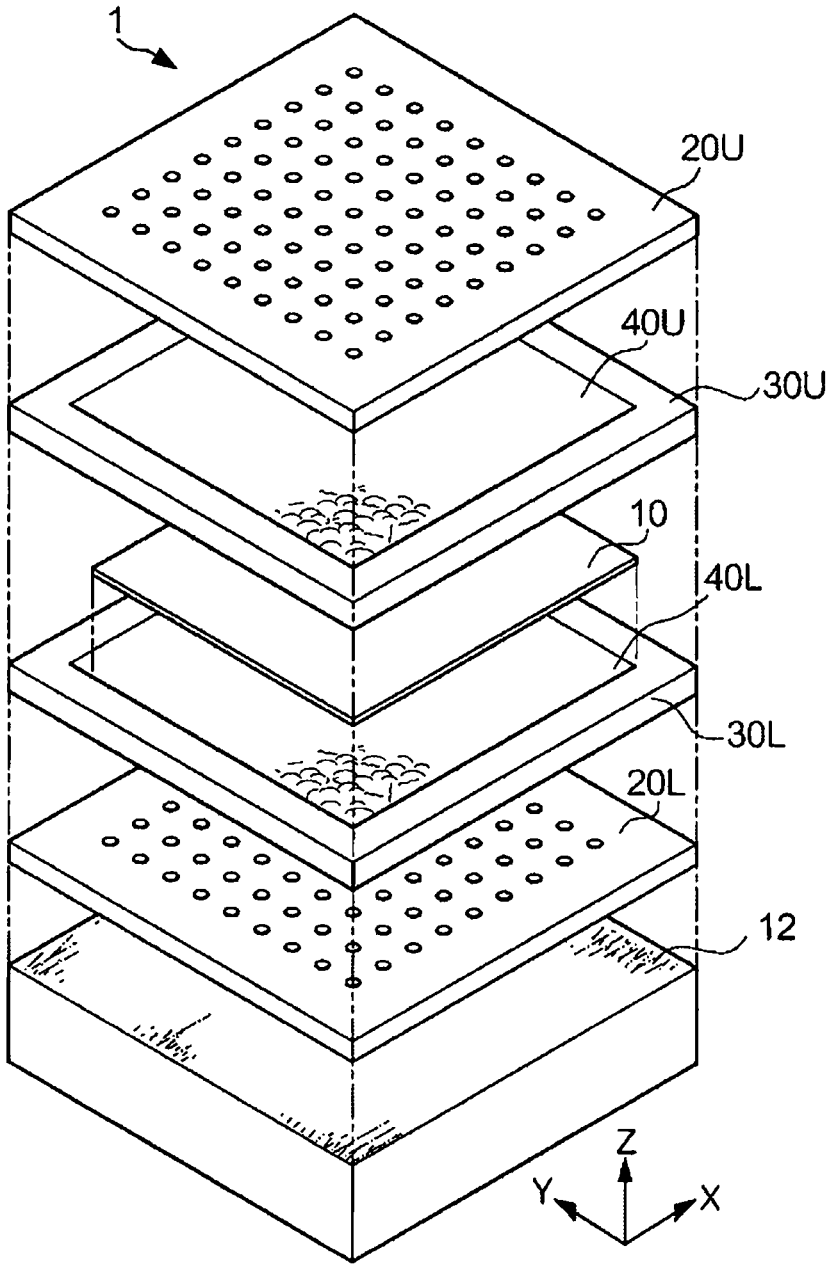
FIG. 3 is an exploded perspective view showing the electrostatic loudspeaker.

FIG. 1 is an external view showing an electrostatic loudspeaker 1 according to an embodiment of the present invention, and FIG. 2 is a schematic view showing the cross-section and electrical configuration of the electrostatic loudspeaker 1. In addition, FIG. 3 is an exploded perspective view showing the electrostatic loudspeaker 1. In this embodiment, the electrostatic loudspeaker 1 has a rectangular parallelepiped shape. In the following descriptions of the figures, the X, Y, and Z axes perpendicular to one another indicate directions, and it is assumed that the left-right direction as viewed from the front of the electrostatic loudspeaker 1 is the X-axis direction, that the depth direction is the Y-axis direction, and that the height direction is the Z-axis direction. Besides, it is assumed that "•" written in "o" in each figure means an arrow directed from the back to the front of the figure. Moreover, "x" written in "o" in each figure means an arrow directed from the front to the back of the figure. The term "front" herein denotes the direction of a face for the convenience of description, but does not denote that the electrostatic loudspeaker 1 is oriented in the front direction when it is placed. When the electrostatic loudspeaker 1 is placed, it may be placed in any direction as necessary. Still further, the dimensions of the respective components shown in the figure are made different from the actual dimensions thereof so that the shapes of the components can be understood easily.

(Configurations of the Respective Components of the Electrostatic Loudspeaker 1)

The electrostatic loudspeaker 1 is roughly divided into a main body 11 and a separation member 12.

First, the configurations of various sections constituting the main body 11 of the electrostatic loudspeaker 1 will be described.

The main body 11 of the electrostatic loudspeaker 1 is the so-called push-pull electrostatic loudspeaker and has a vibrating member 10, electrodes 20U and 20L, spacers 30U and 30L, and elastic members 40U and 40L. In this embodiment, the configurations of the electrodes 20U and 20L are the same, and the configurations of the spacers 30U and 30L are the same. Furthermore, the configurations of the elastic members 40U and 40L are also the same. Hence, in the case that it is not particularly necessary to distinguish between the two in the respective members, the descriptions of "U" and "L" are omitted.

The vibrating member 10 has a configuration in which a metal having conductibility is evaporated or a conductive coating material is applied to both faces of a film made of PET (polyethylene terephthalate), PP (polypropylene), or the like to form conductive membranes. The vibrating member 10 has a rectangular shape as viewed from the Z-axis direction, and the dimension in the Z-axis direction is approximately several pm to several ten pm. Furthermore, the vibrating member 10 has flexibility and is deflected when a force is applied thereto.

The spacer 30 has insulation property and has a rectangular frame shape as viewed from the Z-axis direction. Furthermore, the spacer 30 has flexibility and is deflected when a force is applied thereto. The dimension of the spacer 30 in the X-axis direction is the same as the dimension of the electrode 20 in the X-axis direction, and the dimension of the spacer 30 in the Y-axis direction is the same as the dimension of the electrode 20 in the Y-axis direction. The dimension of the spacer 30U in the Z-axis direction is the same as the dimension of the spacer 30L in the Z-axis direction. The elastic member 40 is a member obtained by heating and compressing cotton and allows air and sound to pass therethrough. In other words, the elastic member 40 has acoustic transmission property. Furthermore, the elastic member 40 has insulation property and elasticity, and it is deformed when an external force is applied thereto and returns to its original shape when the external force is removed. In addition, the elastic member 40 has a rectangular shape as viewed from the Z-axis direction.

The electrode 20 has a configuration in which a metal having conductibility is evaporated or a conductive coating material is applied to one face of a film having insulation property and made of PET, PP, or the like. The electrode 20 has a plurality of through-holes 21 passing through from the front face to the back face. The electrode 20 allows air and sound to pass therethrough. In other words, the electrode 20 has acoustic transmission property. In addition, the electrode 20 has flexibility and is deflected when a force is applied thereto. The electrode 20 has a rectangular shape as viewed from the Z-axis direction. The dimensions of the electrode 20 in the X-axis direction and in the Y-axis direction are longer than the dimensions of the vibrating member 10 in the X-axis direction and in the Y-axis direction.

Next, the configuration of the separation member 12 of the electrostatic loudspeaker 1 will be described. The separation member 12 is a member that is used to separate the main body 11 from a shield to provide an air layer. The term "shield" is an object, such as a floor face, a wall face, or a pillar, which can make contact with the electrostatic loudspeaker 1; an acoustic wave incident to the shield hardly passes therethrough and is easily reflected thereby. The shape of the surface of the shield is not limited to a flat face, but may be a curved face or a face having unevenness. The term "separation" means a state in which a certain object is placed away from a certain position.

The separation member 12 is a member obtained by heating and compressing cotton and allows air and sound to pass therethrough. The separation member 12 has insulation property and elasticity, and it is deformed when an external force is applied thereto and returns to its original shape when the external force is removed. The separation member 12 has a rectangular parallelepiped shape. In the separation member 12, the face in the positive direction of the Z-axis is referred to as the upper face thereof, the face in the negative direction of the Z-axis is referred to as the lower face thereof, and the faces other than the upper face and the lower face are referred to as the circumferential faces thereof. The electrode 20L of the main body 11 is firmly bonded to the upper face of the separation member 12 using an adhesive. The dimension of the separation member 12 in the X-axis direction is the same as the dimension of the main body 11 in the X-axis direction, and the dimension of the separation member 12 in the Y-axis direction is the same as the dimension of the main body 11 in the Y-axis direction. The dimension of the separation member 12 in the Z-axis direction is approximately 5 to 6 cm, that is, a dimension adequate to allow an acoustic wave having passed through the through-holes 21 to be radiated from the circumferential faces of the separation member 12 to the outside of the electrostatic loudspeaker 1. The dimension of the separation member 12 in the Z-axis direction is not limited to 5 to 6 cm, but may be determined appropriately depending on the intensity of the acoustic wave radiated from the main body 11. It is supposed that the separation member 12 has acoustic transmission property higher than that of the spacer 30.

(Structure of the Electrostatic Loudspeaker 1)

Next, the structure of the electrostatic loudspeaker 1 will be described.

In the electrostatic loudspeaker 1, the spacer 30U and the spacer 30L are firmly bonded to each other with one side of the vibrating member 10 held between the lower face of the spacer 30U and the upper face of the spacer 30L. Furthermore, in the electrostatic loudspeaker 1, the electrode 20L is firmly bonded to the lower face of the spacer 30L with the conductive face thereof oriented toward the vibrating member 10, and the electrode 20U is firmly bonded to the upper face of the spacer 30U with the conductive face thereof oriented toward the vibrating member 10. Inside the frame-shaped spacer 30L, the elastic member 40L is disposed. The elastic member 40L makes contact with the vibrating member 10 and the electrode 20L. Furthermore, inside the frame-shaped spacer 30U, the elastic member 40U is disposed. The elastic member 40U makes contact with the vibrating member 10 and the electrode 20U. The separation member 12 is firmly bonded to the lower face of the electrode 20L using an adhesive.

In this embodiment, only one side of the vibrating member 10 is held between the spacer 30U and the spacer 30L, and the other three sides are in a state of not being held between the spacer 30U and the spacer 30L. In other words, the vibrating member 10 is placed between the electrode 20U and the electrode 20L in a state that no tension is applied thereto. However, since the elastic member 40U and the elastic member 40L support the vibrating member 10 while holding it therebetween, when the vibrating member 10 is not in a state of being driven, the vibrating member 10 is placed at an intermediate position between the electrode 20U and the electrode 20L. Moreover, since no tension is applied to the vibrating member 10, even if the electrostatic loudspeaker 1 is deflected, no tension is applied to the vibrating member 10, and no elongation occurs in the vibrating member 10.

(Electrical Configuration of the Electrostatic Loudspeaker 1)

Next, the electrical configuration of the electrostatic loudspeaker 1 will be described. As shown in FIG. 2, a driver 100 is connected to the electrostatic loudspeaker 1. The driver 100 is equipped with a transformer 50, an input section 60, and a bias supply 70. An acoustic signal is input to the input section 60 from the outside. The bias supply 70 is connected to the conductive portion of the vibrating member 10 and to the middle point on the output side of the transformer 50. The bias supply 70 supplies a DC bias to the vibrating member 10. The conductive portion of the electrode 20U is connected to one terminal on the output side of the transformer 50, and the conductive portion of the electrode 20L is connected to the other terminal on the output side of the transformer 50. The input side of the transformer 50 is connected to the input section 60. In this configuration, when an acoustic signal is input to the input section 60, a voltage corresponding to the input acoustic signal is applied across the electrodes 20, whereby the electrostatic loudspeaker 1 operates as a push-pull electrostatic loudspeaker.

(Operation of the Electrostatic Loudspeaker 1)

Next, the operation of the electrostatic loudspeaker 1 will be described. When an acoustic signal is input to the input section 60, a voltage corresponding to the input acoustic signal is applied across the electrode 20U and the electrode 20L from the transformer 50. When a potential difference occurs between the electrode 20U and the electrode 20L due to the applied voltage, an electrostatic force is exerted to the vibrating member 10 placed between the electrode 20U and the electrode 20L in a direction in which the vibrating member 10 is attracted to either the electrode 20U or the electrode 20L.

For example, it is assumed that an acoustic signal is input to the input section 60, this acoustic signal is supplied to the transformer 50, a plus voltage is applied to the electrode 20U, and a minus voltage is applied to the electrode 20L. Since a plus voltage is applied from the bias supply 70 to the vibrating member 10, the vibrating member 10 repels the electrode 20U to which the plus voltage is applied, but is attracted to the electrode 20L to which the minus voltage is applied, thereby being displaced toward the electrode 20L. Furthermore, it is assumed that an acoustic signal is input to the input section 60, this acoustic signal is supplied to the transformer 50, a minus voltage is applied to the electrode 20U, and a plus voltage is applied to the electrode 20L. The vibrating member 10 repels the electrode 20L to which the plus voltage is applied, but is attracted to the electrode 20U to which the minus voltage is applied, thereby being displaced toward the electrode 20U.

In this way, the vibrating member 10 is displaced toward the electrode 20U or toward the electrode 20L depending on the acoustic signal and the direction of the displacement changes sequentially, whereby vibration is generated and an acoustic wave corresponding to the vibration state (frequency, amplitude, and phase) is generated from the vibrating member 10. The generated acoustic wave passes through the elastic members 40 and the electrodes 20, and is radiated to the outside of the main body 11 of the electrostatic loudspeaker 1.

The transmission paths of the acoustic wave generated from the vibrating member 10 will be described.

Figure 4:
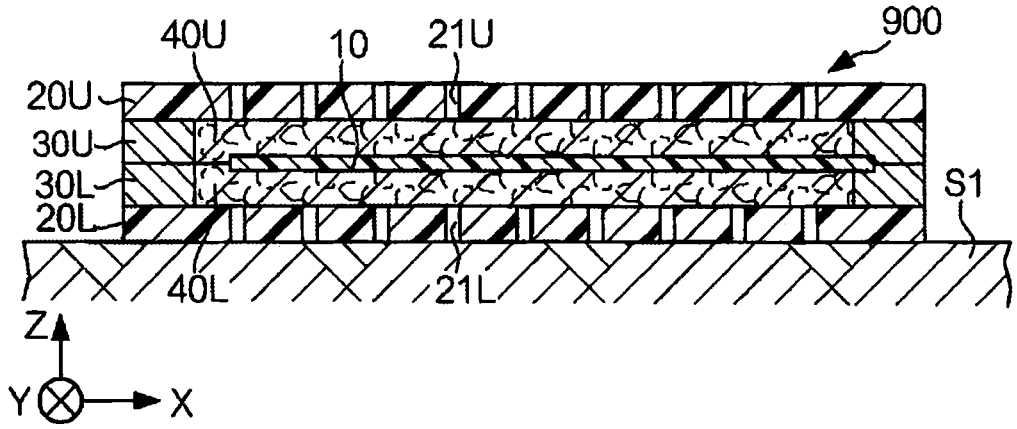
FIGS. 4(*a*) and 4(*b*) are views illustrating the transmission of an acoustic wave.
Figure 4:
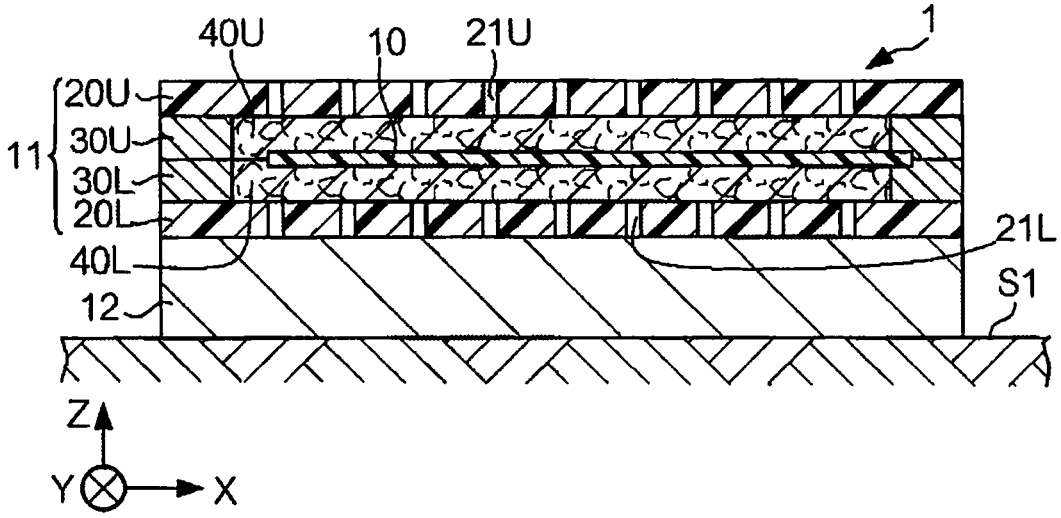

FIGS. 4(*a*) and 4(*b*) are views illustrating the transmission of the acoustic wave. FIG. 4(*a*) shows an electrostatic loudspeaker 900 according to a related art, not equipped with the separation member 12, and FIG. 4(*b*) shows the electrostatic loudspeaker 1 according to this embodiment, equipped with the separation member 12. Respective components constituting the electrostatic loudspeaker 900 are the same as those constituting the main body 11 of the electrostatic loudspeaker 1. Hence, the descriptions of the respective components constituting the electrostatic loudspeaker 900 are omitted.

First, the transmission paths of the acoustic wave radiated from the electrostatic loudspeaker 900 will be described. The electrostatic loudspeaker 900 is installed such that the electrode 20L is made contact with a shield S1. It is assumed that the shield S1 is a floor face, for example, on which objects can be placed. The acoustic wave generated from the vibrating member 10 is radiated in the positive direction of the Z-axis and in the negative direction of the Z-axis. The acoustic wave generated in the positive direction of the Z-axis passes through the elastic member 40U and the electrode 20U and is radiated to the outside of the electrostatic loudspeaker 900. On the other hand, the acoustic wave generated in the negative direction of the Z-axis passes through the elastic member 40L and enters the through-holes 21L of the electrode 20L. However, since the electrode 20L makes contact with the shield S1, the through-holes 21L are blocked by the shield S1. As a result, the acoustic wave having entered the through-holes 21L is reflected by the shield S1 and cannot pass through the through-holes 21L. In other words, the acoustic wave generated in the negative direction of the Z-axis is not radiated to the outside of the electrostatic loudspeaker 900.

Next, the transmission paths of the acoustic wave radiated from the electrostatic loudspeaker 1 according to the present invention equipped with the separation member 12 shown in FIG. 4(*b*) will be described. The electrostatic loudspeaker 1 is installed such that the lower face of the separation member 12 is made contact with the shield S1. The acoustic wave generated from the vibrating member 10 is radiated in the positive direction of the Z-axis and in the negative direction of the Z-axis. The acoustic wave generated in the positive direction of the Z-axis passes through the elastic member 40U and the electrode 20U and is radiated to the outside of the electrostatic loudspeaker 1. On the other hand, the acoustic wave generated in the negative direction of the Z-axis passes through the elastic member 40L and enters the through-holes 21L of the electrode 20L. In this case, since the electrode 20L makes contact with the separation member 12, the through-holes 21L are blocked by the separation member 12. However, since the separation member 12 allows air and sound to pass therethrough, the acoustic wave having entered the through-holes 21L can pass through the through-holes 21L. As a result, the acoustic wave having passed through the through-holes 21L passes through the separation member 12 and is reflected by the shield S1, and then radiated from the circumferential faces of the separation member 12 to the outside of the electrostatic loudspeaker 1.

As described above, in the electrostatic loudspeaker 1, the through-holes 21L are not blocked by the shield. Hence, in the electrostatic loudspeaker 1, the acoustic wave having passed through the through-holes 21L can be radiated from the circumferential faces of the separation member 12. In other words, the electrostatic loudspeaker 1 can radiate the acoustic wave generated from both faces of the vibrating member to the outside of the electrostatic loudspeaker.

For example, in the case that the separation member 12 is not provided between the vibrating member 10 and the shield and that no distance is securely obtained between the vibrating member 10 and the shield, the air being present between the vibrating member 10 and the shield is difficult to move even if the vibrating member 10 vibrates, and the viscosity of the air being present between the vibrating member 10 and the shield affects the vibration of the vibrating member 10, whereby the sound pressure is lowered. On the other hand, in the electrostatic loudspeaker 1 according to this embodiment, a distance is securely obtained between the vibrating member 10 and the shield by virtue of the separation member 12, and the air being present between the vibrating member 10 and the shield is easy to move. Hence, when this case is compared with the case in which the separation member 12 does not exist between the vibrating member 10 and the shield and no distance is securely obtained therebetween, the vibrating member 10 is less affected by the viscosity of the air being present between the shield and the vibrating member 10, whereby the sound pressure of the sound to be output can be raised.

In addition, the electrostatic loudspeaker 1 is formed of components that are deflected when a force is applied thereto. Hence, the electrostatic loudspeaker 1 can be deflected, thereby being able to be installed not only on a flat face but also on a curved face.

[Modifications]

The above-mentioned embodiment is just one example of the embodiment according to the present invention. The present invention can be implemented in embodiments in which the following modifications are applied to the above-mentioned embodiment. The following modifications may be appropriately combined and implemented as necessary.

(Modification 1)

In the above-mentioned embodiment, the vibrating member 10 is a member obtained by evaporating a conductive metal or by applying a conductive coating material onto both faces of a film, but may be a member obtained by evaporating a conductive metal or by applying a conductive coating material onto one face of the film. In addition, the vibrating member 10 is not limited to be made of PET or PP, but may be a member obtained by evaporating a conductive metal or by applying a conductive coating material onto a film of another synthetic resin.

In the above-mentioned embodiment, the electrode 20 is provided with the plurality of through-holes 21 passing therethrough from the front face to the back face. However, the electrostatic loudspeaker 1 is not limited to have the through-holes 21, but should only have a configuration in which at least an acoustic wave can be radiated to the outside of the electrostatic loudspeaker 1. For example, the electrode 20 may be a cloth-like electrode woven with conductive fiber or may be made of conductive non-woven cloth; the electrode should only have conductibility and flexibility and allow air and sound to pass therethrough. Furthermore, the electrode 20 is a member obtained by evaporating a conductive metal or by applying a conductive coating material onto one face of a film, but may be a member obtained by evaporating a conductive metal or by applying a conductive coating material onto both faces of the film. In addition, the electrode 20 is not limited to be made of PET or PP, but may be a member obtained by evaporating a conductive metal or by applying a conductive coating material onto a sheet of another synthetic resin.

(Modification 2)

In the above-mentioned embodiment, the main body 11 and the separation member 12 of the electrostatic loudspeaker 1 are firmly bonded to each other using an adhesive. However, without the main body 11 and the separation member 12 firmly bonded to each other, they may be configured so that their positions are not displaced relative to each other.

Figure 5:
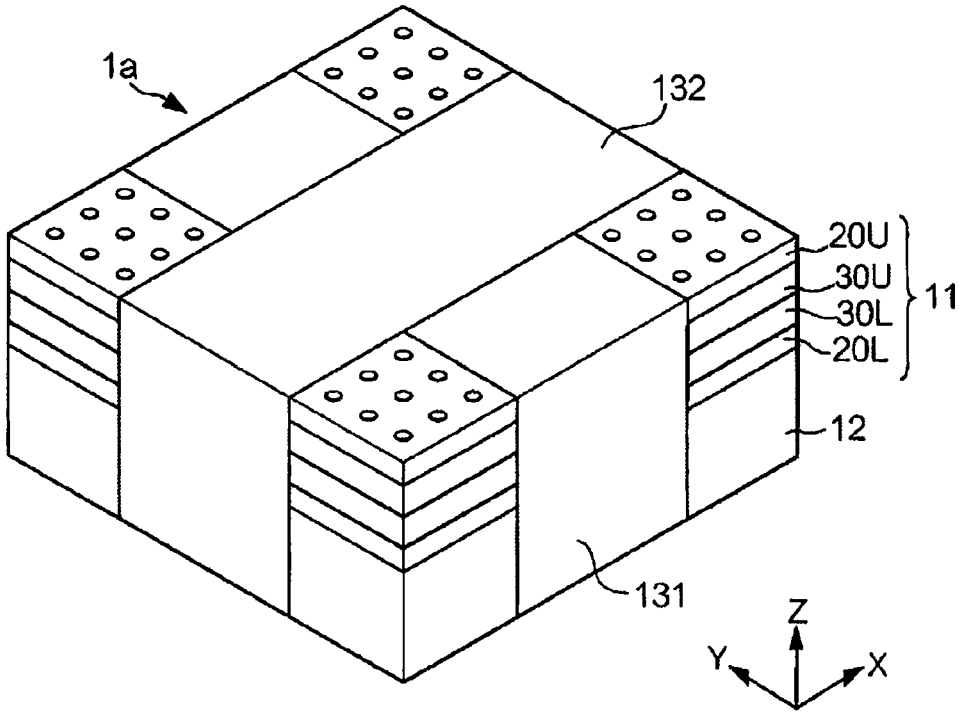
FIGS. 5(*a*) and 5(*b*) are views showing an electrostatic loudspeaker in which the positional displacement thereof is suppressed according to a modification of the present invention.
Figure 5:
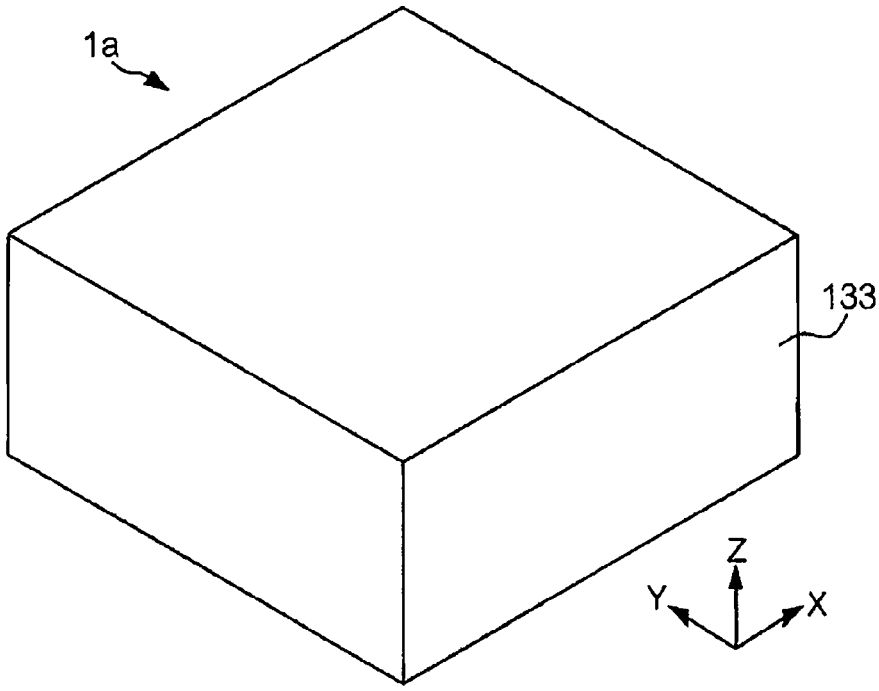

FIGS. 5(*a*) and 5(*b*) are views showing an electrostatic loudspeaker 1*a* in which the positional displacement thereof is suppressed according to a modification of the present invention. In FIG. 5(*a*), a restraining member 131 and a restraining member 132 are an endless belt, have insulation property, and allow air and sound to pass therethrough. The restraining member 131 is wound in the Y-axis direction so that the main body 11 and the separation member 12 are integrated into one body, whereby the position of the main body 11 and the position of the separation member 12 are suppressed from being displaced relative to each other in the Y-axis direction and in the Z-axis direction. Furthermore, the restraining member 132 is wound in the X-axis direction so that the main body 11 and the separation member 12 are integrated into one body, whereby the position of the main body 11 and the position of the separation member 12 are suppressed from being displaced relative to each other in the X-axis direction and in the Z-axis direction. As a result, the main body 11 and the separation member 12 are suppressed from being displaced relative to each other as in the case that they are firmly bonded to each other using an adhesive.

Furthermore, although the relative positional displacement is suppressed by winding the restraining members on the surfaces of the main body 11 and the separation member 12 as shown in FIG. 5(*a*), the relative positional displacement may be suppressed by covering the entire areas of the surfaces of the main body 11 and the separation member 12 using a restraining member as shown in FIG. 5(*b*). In FIG. 5(*b*), a restraining member 133 is a piece of cloth formed to cover the surfaces of the main body 11 and the separation member 12 by integrating them into one body, and the cloth has insulation property and allows air and sound to pass therethrough. The restraining member 133 covers the main body 11 and the separation member 12 by integrating them into one body, whereby the positions of the main body 11 and the separation member 12 are suppressed from being displaced relative to each other in the X-axis direction, in the Y-axis direction, and in the Z-axis direction. As a result, the main body 11 and the separation member 12 are suppressed from being displaced relative to each other as in the case that they are firmly bonded to each other using an adhesive.

(Modification 3)

The electrostatic loudspeaker may be configured so as to be integrated with an amplifier for amplifying an acoustic signal.

Figure 6:
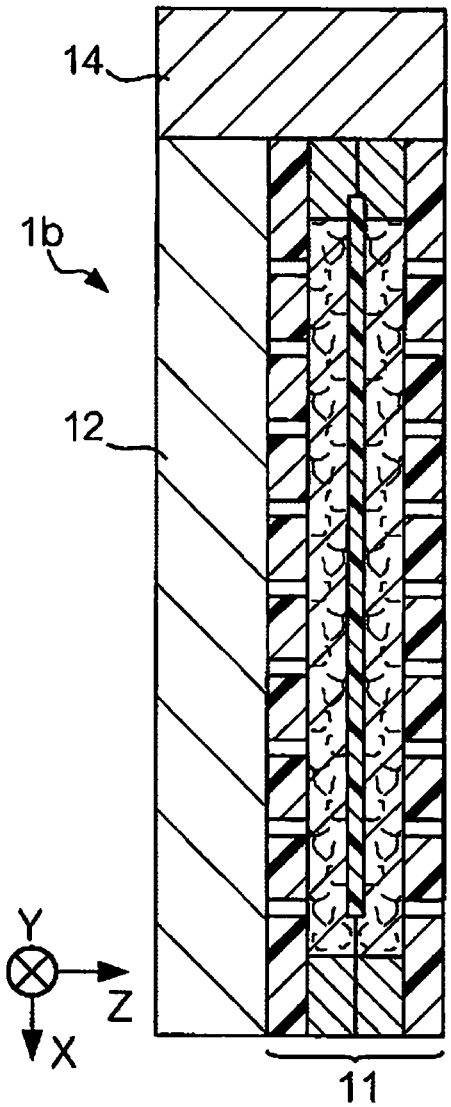
FIG. 6 is a view showing an electrostatic loudspeaker equipped with an amplifier according to a modification of the present invention.

FIG. 6 is a view showing an electrostatic loudspeaker 1*b* equipped with an amplifier according to a modification of the present invention. In the electrostatic loudspeaker 1*b*, an amplifier 14 is mounted on a circumferential face thereof. The amplifier 14 amplifies an acoustic signal input from the outside and outputs the acoustic signal. The acoustic signal output from the amplifier 14 is input to the input section 60 of the driver 100 provided for the main body 11. In the electrostatic loudspeaker 1*b* configured as described above, no amplifier is required to be connected thereto separately, and it is not required to consider the disposition of the amplifier. In other words, the installation of the electrostatic loudspeaker 1*b* is made easy. Furthermore, in the electrostatic loudspeaker 1*b*, the main body 11 is not required to be equipped with the driver 100. In this case, a function equivalent to that of the driver 100 may be provided as the function of the amplifier 14, for example.

(Modification 4)

In the above-mentioned embodiment, the separation member 12 is provided between the shield and the electrode 20L opposed to the shield. However, the position in which the separation member 12 is provided is not limited to this position.

Figure 7:
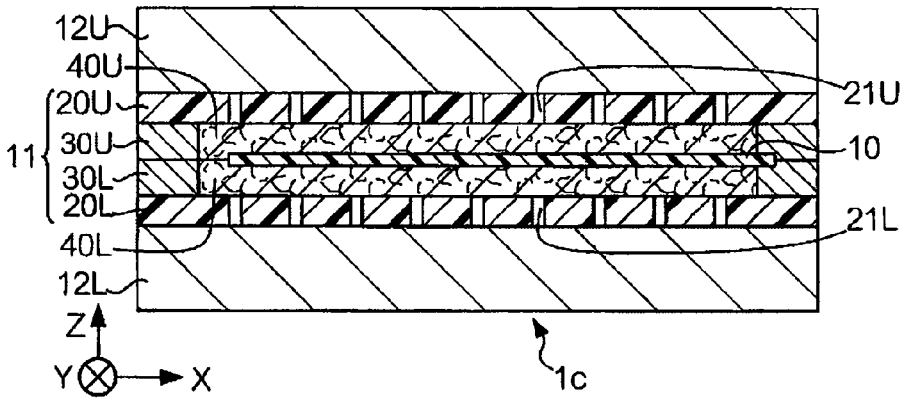
FIG. 7 is a sectional view showing an electrostatic loudspeaker according to a modification of the present invention.

FIG. 7 is a sectional view showing an electrostatic loudspeaker 1*c* according to a modification of the present invention. As shown in the figure, in the electrostatic loudspeaker 1*c*, a separation member 12L is firmly bonded to the lower face of the electrode 20L, and a separation member 12U is firmly bonded to the upper face of the electrode 20U. In other words, in the electrostatic loudspeaker 1*c*, the main body 11 is held between the separation member 12U and the separation member 12L. In the electrostatic loudspeaker 1*c* configured as described above, even if the separation member 12U is made contact with a shield, the through-holes 21U are not blocked by the shield. Furthermore, even if the separation member 12L is made contact with a shield, the through-holes 21L are not blocked by the shield. In other words, in the electrostatic loudspeaker 1*c*, even if either the separation member 12U or the separation member 12L is made contact with a shield, the acoustic wave generated from both faces of the vibrating member can be radiated to the outside of the electrostatic loudspeaker 1*c*.

Moreover, since the electrostatic loudspeaker 1*c* is configured so that the main body 11 is held between the separation members 12 having elasticity, it may be possible that an impact applied to the electrostatic loudspeaker 1*c* is absorbed by the separation members 12 and the impact transmitted to the main body 11 is reduced. Still further, since the electrostatic loudspeaker 1*c* is configured so that the electrode 20 is covered with the separation members 12, it may be possible that the occurrence of electric shock and short-circuit is suppressed.

(Modification 5)

The shape of the separation member is not limited to a cube, but may be a pillar or a cone. In addition, the face of the separation member on which the main body is provided is not limited to be a flat face, but may be a curved face.

Figure 8:
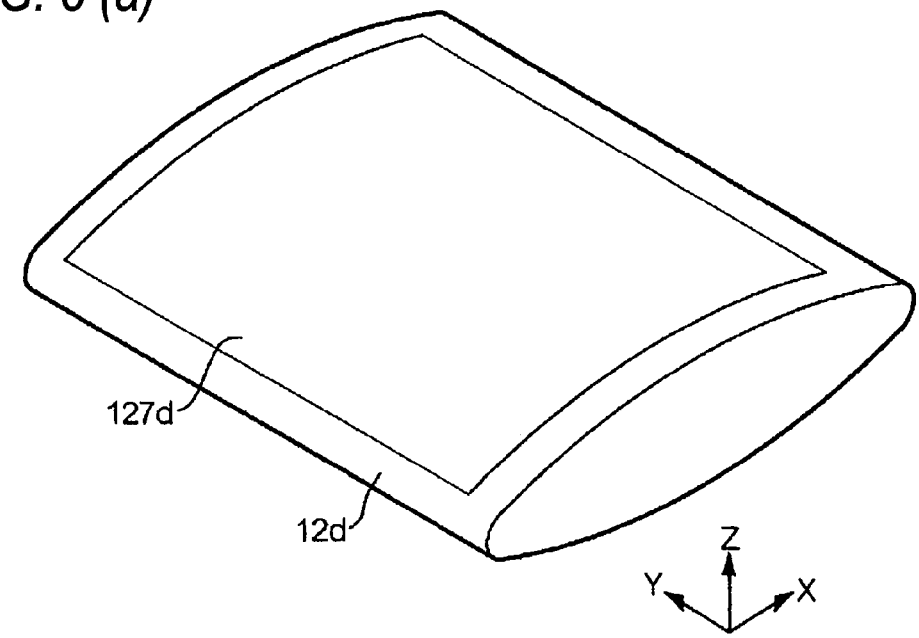
FIGS. 8(*a*) and 8(*b*) are external perspective views showing a separation member according to a modification of the present invention.
Figure 8:
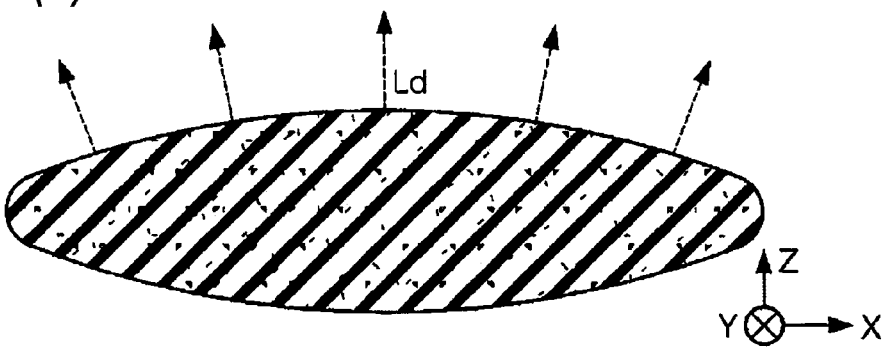

FIG. 8(*a*) is an external perspective view showing a separation member 12*d*, and FIG. 8(*b*) is a schematic view showing the transmission paths of an acoustic wave. As shown in the figures, the upper face of the separation member 12*d* is formed into a convex shape. In the case that an electrostatic loudspeaker is configured by bonding the main body to the area 127*d* on the upper face of the separation member 12*d*, the shape of upper face of the main body becomes a convex shape similar to the shape of the separation member 12*d*. In this case, since the acoustic wave radiated from the main body is diffused along the transmission paths Ld shown in FIG. 8(*b*), the wave is diffused to a space wider than the space of the area 127*d* in the Z-axis direction.

Figure 9:
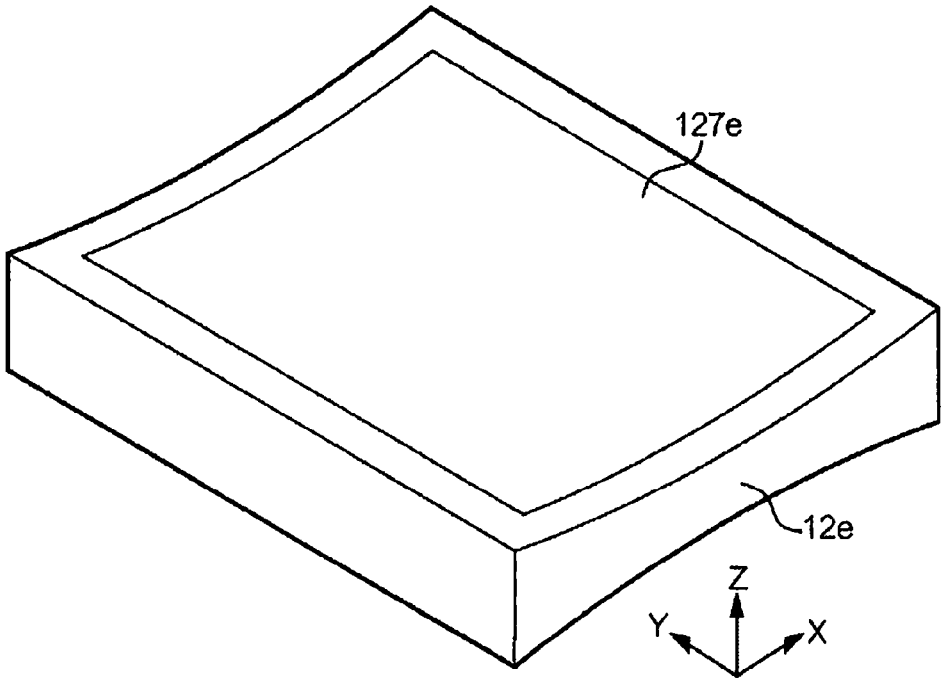
FIGS. 9(*a*) and 9(*b*) are external perspective views showing a separation member according to a modification of the present invention.
Figure 9:
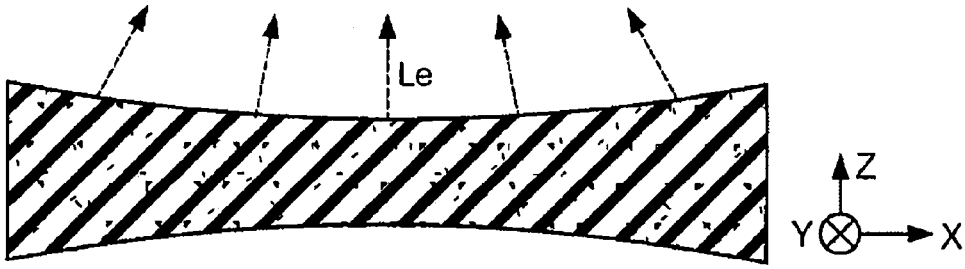

FIG. 9(*a*) is an external perspective view showing a separation member 12*e*, and FIG. 9(*b*) is a schematic view showing the transmission paths of an acoustic wave. As shown in the figures, the upper face of the separation member 12*e* is formed into a concave shape. In the case that an electrostatic loudspeaker is configured by bonding the main body to the area 127*e* on the upper face of the separation member 12*e*, the shape of the upper face of the main body becomes a concave shape similar to the shape of the separation member 12*e*. In this case, since the acoustic wave radiated from the main body is diffused along the transmission paths Le shown in FIG. 9(*b*), the wave is diffused to a space narrower than the space of the area 127*e* in the Z-axis direction.

Hence, for example, in the case that an acoustic wave is desired to be radiated to a wide space, the main body should only be provided on the separation member formed into a convex shape. Furthermore, in the case that an acoustic wave is desired to be radiated to a narrow space, the main body should only be provided on the separation member formed into a concave shape. The shape of the separation member and the position in which the main body is provided on the separation member are arbitrary and should only be determined depending on the direction in which the acoustic wave is desired to be radiated.

The shape of the separation member may be determined to a shape matched to the shape of a shield.

Figure 10:
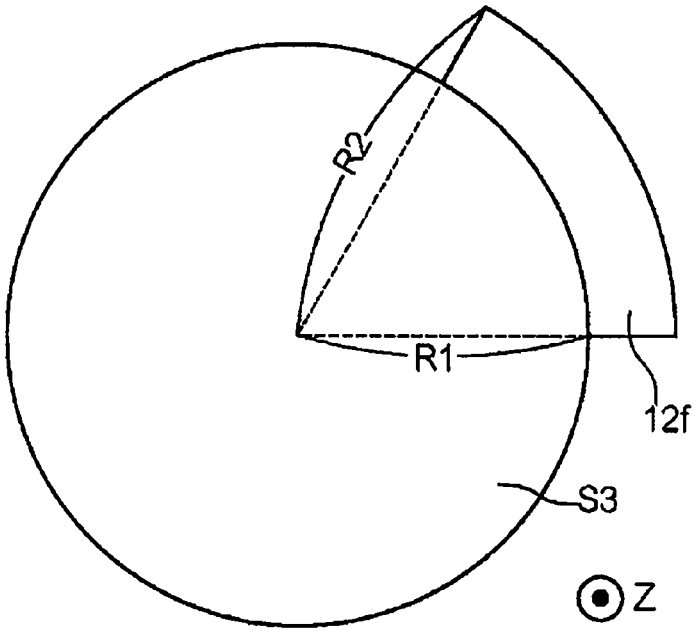
FIG. 10 is a schematic view showing a separation member and a shield according to a modification of the present invention.

FIG. 10 is a schematic view showing a separation member 2*f* and a shield S3 according to a modification of the present invention. In FIG. 10, the shield S3 is a cylinder having a radius of R1. In this case, the separation member 12*f* should only be determined so as to have a shape to be wound around the outer circumferential face of the shield S3, that is, so that a curved face of a radius of R1 becomes the inner circumferential face thereof. The separation member 12*f* configured as described above can be provided for the shield S3 without being deflected. Furthermore, it is assumed that the separation member 12*f* is determined so that a curved face of a radius R2 (R1<R2) becomes the outer circumferential face thereof. In this case, an electrostatic loudspeaker is configured by bonding the main body to the outer circumferential face of the separation member 12*f*. The outer circumferential face of the separation member 12*f* is not limited to a curved face, but may be formed into a flat face.

Figure 11:
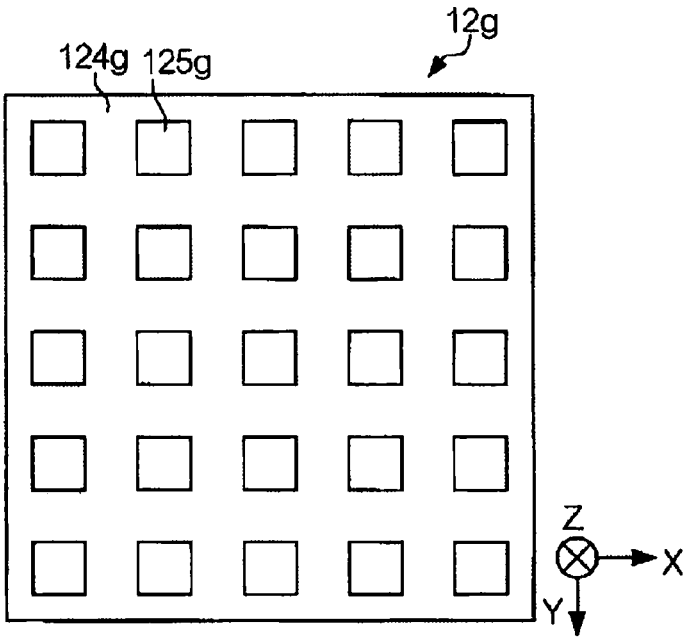
FIGS. 11(*a*), 11(*b*), and 11(*c*) are views showing the structure of a separation member according to a modification of the present invention.
Figure 11:
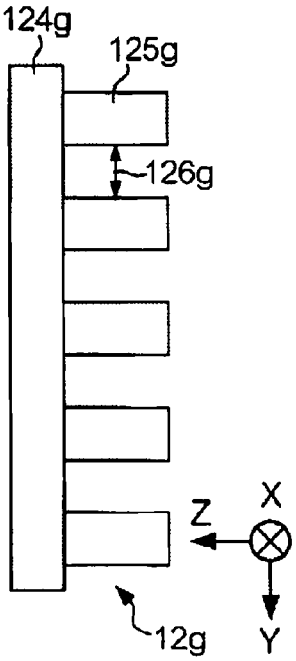
Figure 11:
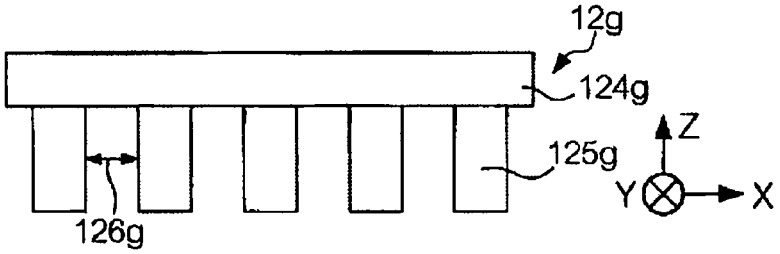

The separation member may be configured so as to be deformed more easily than that having a cubic shape. FIGS. 11(*a*), 11(*b*), and 11(*c*) are views showing the structure of a separation member 12*g* according to a modification of the present invention. FIG. 11(*a*) is a bottom view showing the separation member 12*g*, FIG. 11(*b*) is a front view showing the separation member 12*g*, and FIG. 11(*c*) is a side view showing the separation member 12*g*. An electrostatic loudspeaker is configured by bonding the main body to the upper face of the separation member 12*g*. The separation member 12*g* has a rectangular shape as viewed from the Z-axis direction and is equipped with a base 124*g* and a plurality of protrusions 125*g*. The base 124*g* and the protrusions 125*g* are obtained by heating and compressing cotton and allow air and sound to pass therethrough. The separation member 12*g* has insulation property and elasticity, and it is deformed when an external force is applied thereto and returns to its original shape when the external force is removed. On the lower face of the base 124*g*, the plurality of protrusions 125*g* are provided at predetermined intervals (spacing 126*g*) in the X-axis direction and in the Y-axis direction. The protrusions 125*g* have a quadrangular prism shape, and each protrusion 125*g* has a rectangular parallelepiped shape in which the side in the X-axis direction is equal to the side in the Y-axis direction. Furthermore, one end of the protrusion 125*g* is a fixed end secured to the base 124*g*, and the other end of the protrusion 125*g* is a free end not secured to the base 124*g*. For example, it is assumed that the base 124*g* is bent convexly at the center of the lower face. In this case, the spacing 126*g* between the protrusions 125*g* adjacent to each other becomes wider in the direction from the fixed end to the free end. In addition, it is assumed that the base 124*g* is bent concavely at the center of the lower face. In this case, the spacing 126*g* between the protrusions 125*g* adjacent to each other becomes narrower in the direction from the fixed end to the free end. In other words, the separation member 12*g* is configured so that the free end of the protrusion 125*g* is movable as the base 124*g* is bent, whereby the separation member 12*g* can be bent without causing expansion or contraction of the lower face of the separation member 12*g*. Hence, the separation member 12*g* having the plurality of protrusions 125*g* can be bent more flexibly depending on the shape of a shield than a separation member having no protrusions. Furthermore, since the separation member 12*g* can be wound, it is stored and carried easily. Although the plurality of protrusions 125*g* are provided at predetermined intervals in the X-axis direction and in the Y-axis direction on the lower face of the base 124*g*, the protrusions 125*g* may be provided at predetermined intervals either in the X-axis direction or in the Y-axis direction.

Figure 12:
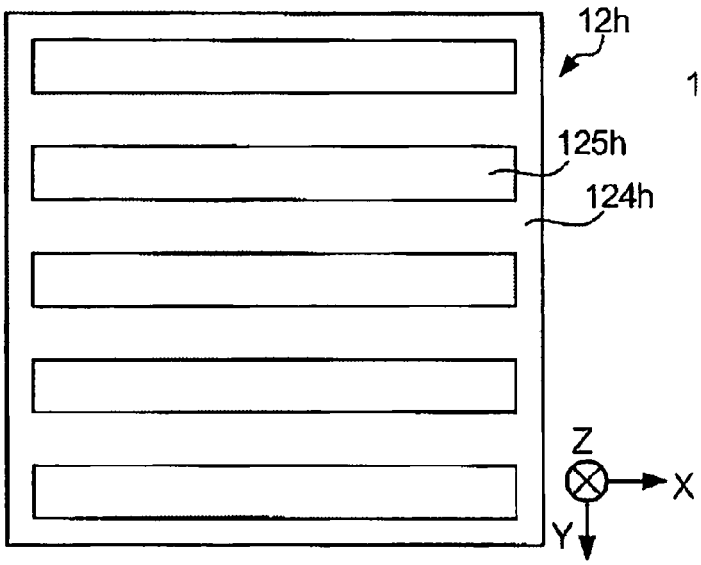
FIGS. 12(*a*), 12(*b*), and 12(*c*) are views showing the structure of a separation member according to a modification of the present invention.
Figure 12:
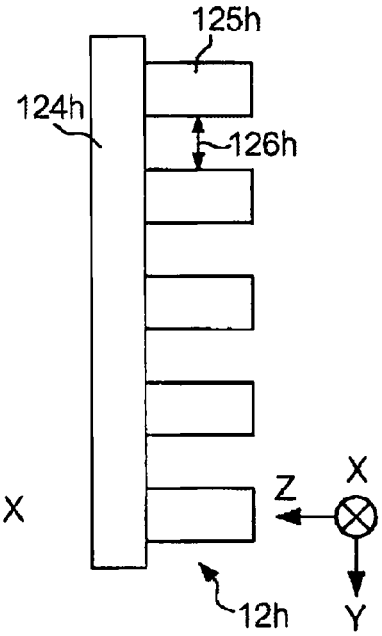
Figure 12:
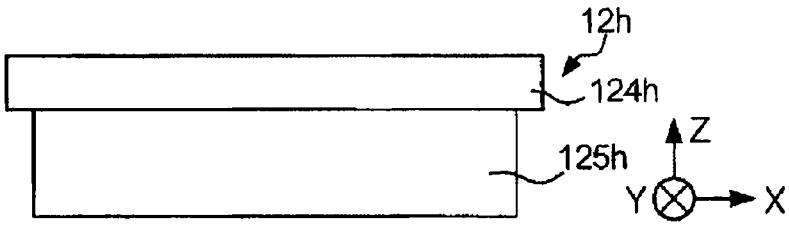

FIGS. 12(*a*), 12(*b*), and 12(*c*) are views showing the structure of a separation member 12*h* according to a modification of the present invention. FIG. 12(*a*) is a bottom view showing the separation member 12*h*, FIG. 12(*b*) is a front view showing the separation member 12*h*, and FIG. 12(*c*) is a side view showing the separation member 12*h*. An electrostatic loudspeaker is configured by bonding the main body to the upper face of the separation member 12*h*, and the separation member is provided by making the lower face thereof into contact with a shield. The separation member 12*h* has a rectangular shape as viewed from the Z-axis direction and is equipped with a base 124*h* and a plurality of protrusions 125*h*. It is assumed that the base 124*h* and the protrusions 125*h* are formed of the same material as that of the base 124*g* and the protrusions 125*g*. On the lower face of the base 124*h*, the plurality of protrusions 125*h* are provided at predetermined intervals (spacing 126*h*) in the Y-axis direction. The protrusions 125*h* have a quadrangular prism shape, and each protrusion 125*h* has a rectangular parallelepiped shape extended in the X-axis direction in which the side in the X-axis direction is longer than the side in the Y-axis direction. Furthermore, one end of the protrusion 125*h* is a fixed end secured to the base 124*h*, and the other end of the protrusion 125*h* is a free end not secured to the base 124*h*. For example, it is assumed that the base 124*h* is bent convexly at the center of the lower face. In this case, the spacing 126*h* between the protrusions 125*h* adjacent to each other becomes wider in the direction from the fixed end to the free end. In addition, it is assumed that the base 124*h* is bent concavely at the center of the lower face. In this case, the spacing 126*h* between the protrusions 125*h* adjacent to each other becomes narrower in the direction from the fixed end to the free end. In other words, the separation member 12*h* is configured so that the free end of the protrusion 125*h* is movable as the base 124*h* is bent, whereby the separation member 12*h* can be bent without causing expansion or contraction of the lower face of the separation member 12*h*. Hence, the separation member 12*h* having the plurality of protrusions 125*h* can be bent more flexibly depending on the shape of a shield than a separation member having no protrusions. Furthermore, since the separation member 12*h* can be wound, it is stored and carried easily.

(Modification 6)

Figure 13:
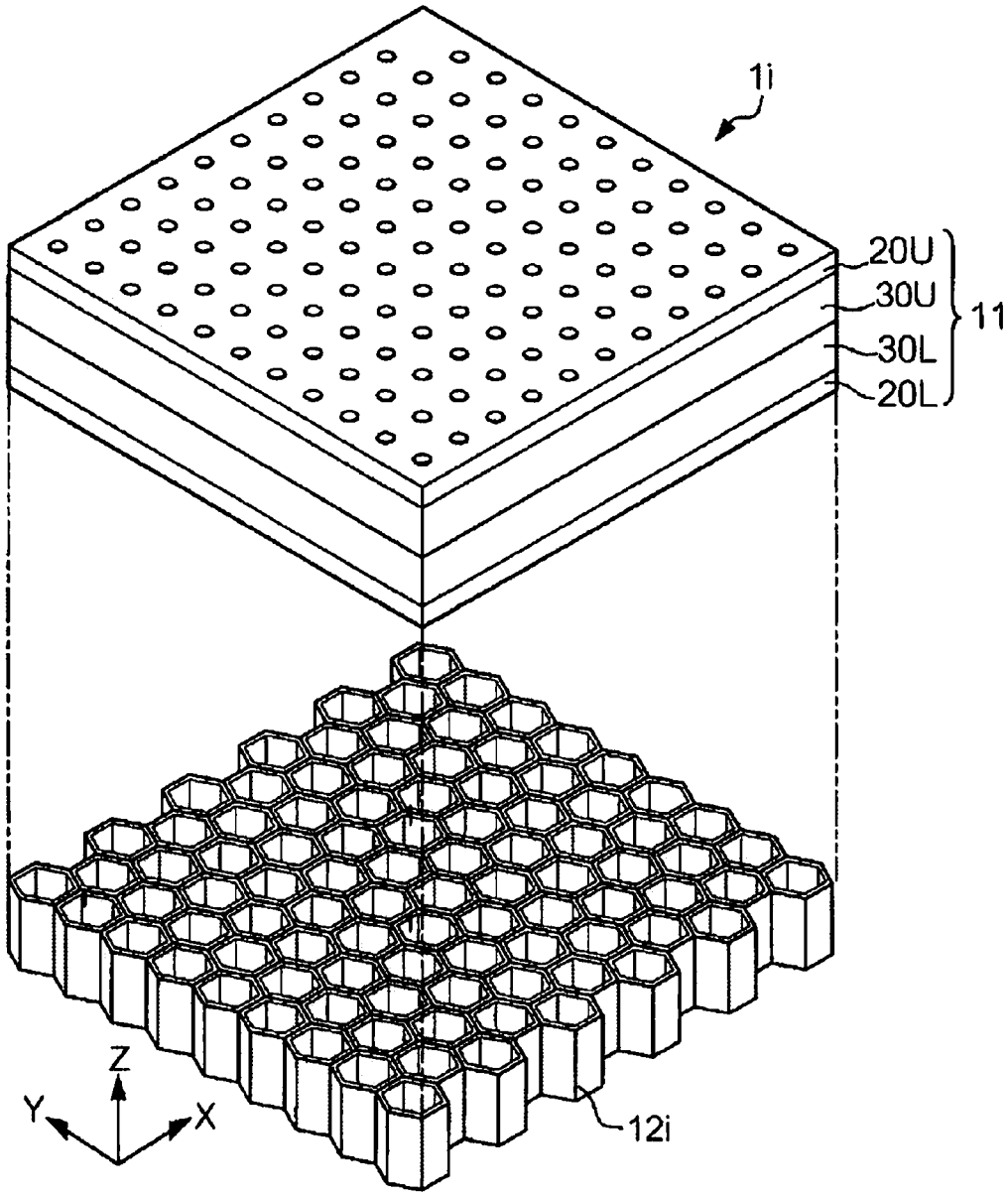
FIG. 13 is an exploded perspective view showing an electrostatic loudspeaker according to a modification of the present invention.

FIG. 13 is an exploded perspective view showing an electrostatic loudspeaker 1*i* according to a modification of the present invention.

A separation member 12*i* is a non-conductive member made of thin paper or the like allowing air and sound to pass therethrough and has a shape in which a plurality of spaces (cells) having a hexagonal shape as viewed from the above are joined together without clearances as in the case of a honeycomb. Innumerable holes may be formed in the thin paper to allow air and sound to easily pass through between the cells. When the electrostatic loudspeaker 1*i* is configured, one end face of the separation member 12*i* in the height direction thereof (in a direction orthogonal to the cross section of the hexagon) is made close contact with the surface of the electrode 20L of the main body 11 and the separation member 12*i* is firmly bonded to the electrode 20L using an adhesive or an adhesive tape. In this way, the electrostatic loudspeaker 1*i* having the separation member 12*i* is configured. In the electrostatic loudspeaker 1*i*, the electrode 20L of the main body 11 is bonded to the separation member 12*i* that allows air and sound to passing therethrough; hence, the acoustic wave generated from both faces of the vibrating member can be radiated to the outside of the electrostatic loudspeaker 1*i*. Although the shape of the cells of the separation member 12*i* is a hexagonal shape, the shape may be other shapes, such as a rectangular shape, a wavy shape or a trapezoidal shape.

(Modification 7)

The separation member may have a shape capable of being secured to a wall face or the like.

Figure 14:
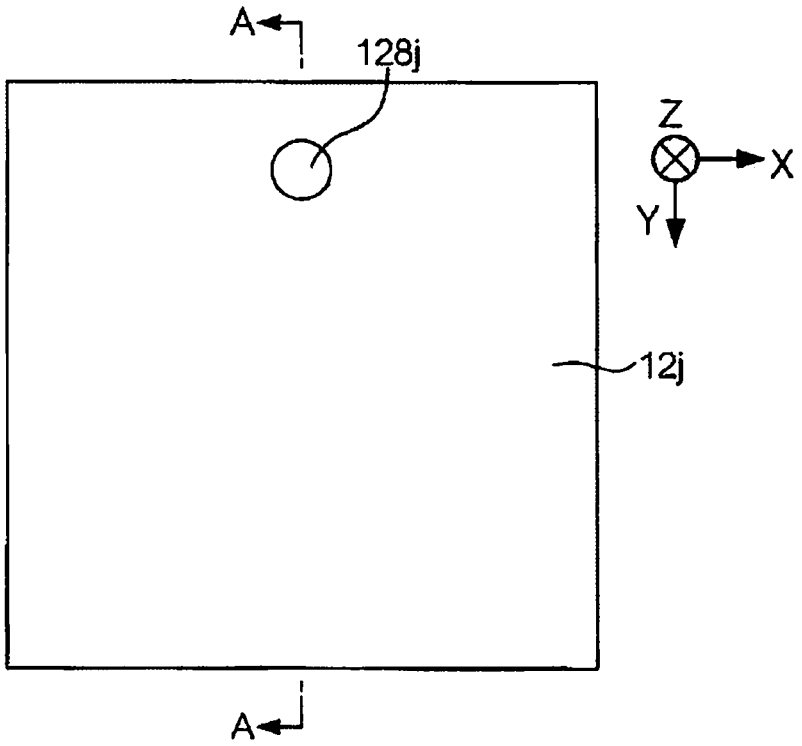
FIG. 14 is a view showing the lower face of a separation member according to a modification of the present invention.
Figure 15:
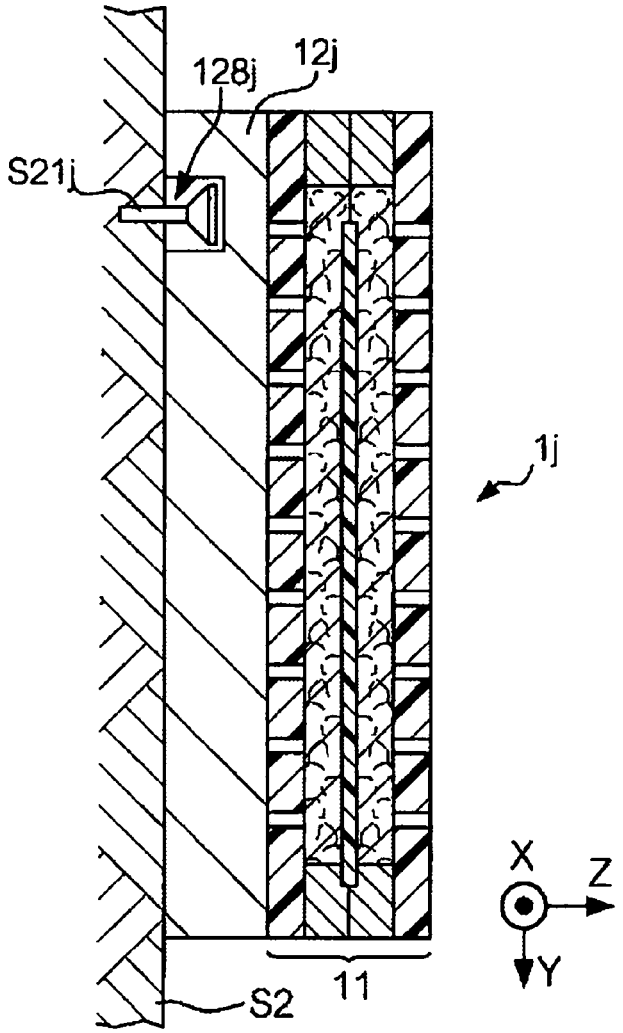
FIG. 15 is a view showing an electrostatic loudspeaker secured to a shield according to a modification of the present invention.

FIG. 14 is a view showing the lower face of a separation member 12*j* according to a modification of the present invention. FIG. 15 is a sectional view taken on line A-A of an electrostatic loudspeaker 1*j* equipped with the separation member 12*j* shown in FIG. 14 and is a view showing the electrostatic loudspeaker 1*j* secured to a shield S2. It is assumed that the shield S2 is, for example, a wall on which no object can be placed. Furthermore, a holding member S21*j* is, for example, a screw or a nail, and part thereof is inserted into the shield S2, thereby being secured to the shield S2. The description is herein returned to FIG. 14. In the separation member 12*j*, a hole 128*j* opening from the inside to the lower face of the separation member 12*j* is provided. The hole 128*j* has a circular shape as viewed from the Z-axis direction and is open so as to have a size adequate to allow the holding member S21*j* to be inserted therein. As shown in FIG. 15, the electrostatic loudspeaker 1*j* is configured by bonding the main body 11 to the upper face of the separation member 12*j*. Then, the holding member S21*j* is inserted into the hole 128*j*, whereby the electrostatic loudspeaker 1*j* is secured to the shield S2. In other words, since the electrostatic loudspeaker 1*j* is not required to be separately equipped with members for securing the electrostatic loudspeaker to the shield S2, the electrostatic loudspeaker can be installed easily on a shield, such as a wall face, on which no object can be placed.

The hole provided in the separation member is not limited to a hole having a circular shape.

Figure 16:
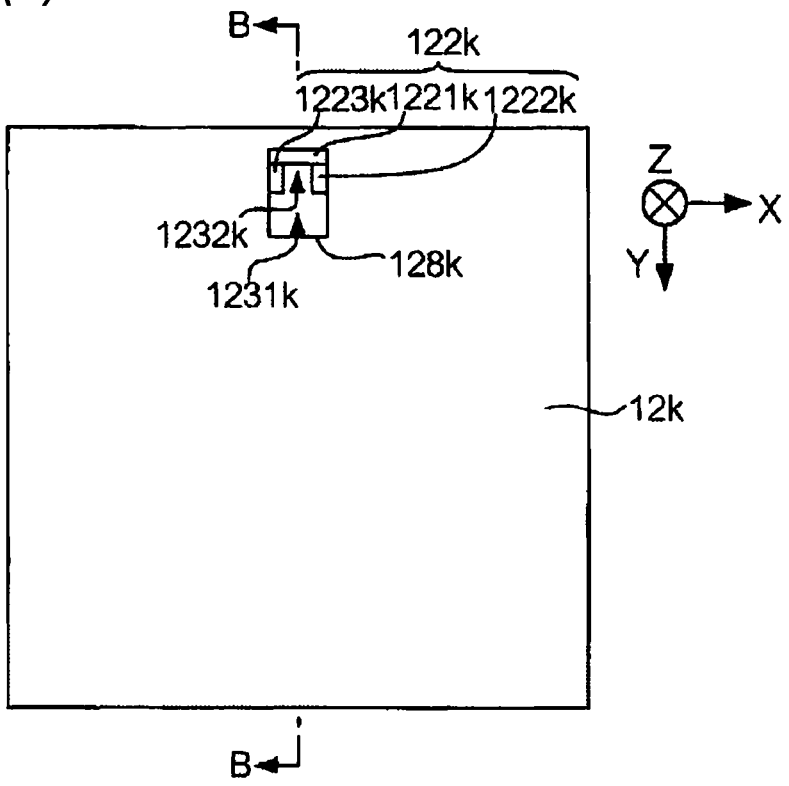
FIGS. 16(*a*) and 16(*b*) are views showing a separation member and a holding member according to a modification of the present invention.
Figure 16:
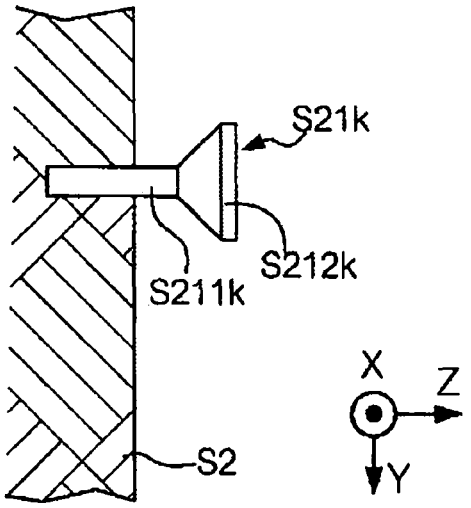

FIGS. 16(*a*) and 16(*b*) are views showing a separation member 12*k* and a holding member S21*k* according to a modification of the present invention. FIG. 16(*a*) is a bottom view showing the separation member 12*k* according to the modification of the present invention. FIG. 16(*b*) is a view showing the structures of the shield S2 and the holding member S21*k*. Furthermore, the holding member S21*k* is, for example, a screw or a nail, and includes a body S211*k* and a head S212*k*. Part of the body S211*k* of the holding member S21*k* is inserted into the shield S2, whereby the holding member S21*k* is secured to the shield S2. The head S212*k* is formed so as to be thicker than the body S211*k*.

Figure 17:
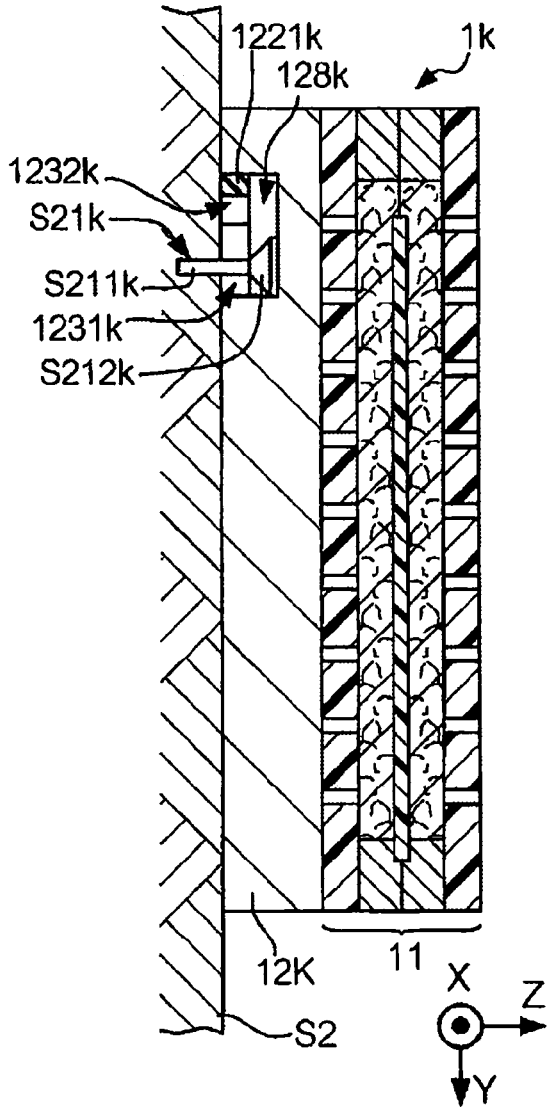
FIGS. 17(*a*) and 17(*b*) are views showing an electrostatic loudspeaker secured to a shield according to a modification of the present invention.
Figure 17:
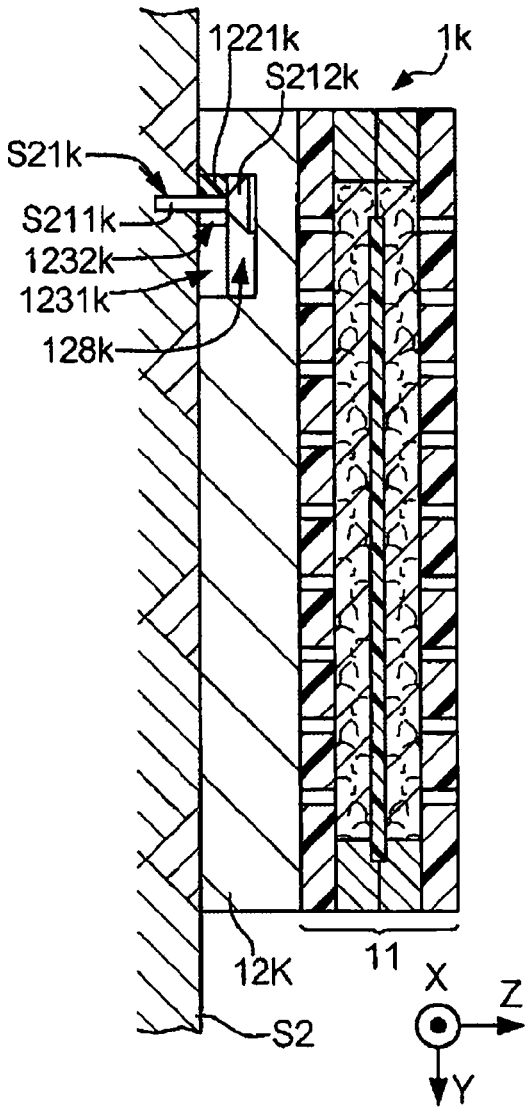

The description is herein returned to FIG. 16(*a*). In the separation member 12*k*, a hole 128*k* opening from the inside to the lower face of the separation member 12*k* is provided. The hole 128*k* has a rectangular shape as viewed from the Z-axis direction. In the hole 128*k*, out of the two sides along the X-axis direction, the side in the positive direction of the Y-axis is referred to as a side X1, and the side in the negative direction of the Y-axis is referred to as a side X2; and out of the two sides along the Y-axis direction, the side in the positive direction of the X-axis is referred to as a side Y1, and the side in the negative direction of the X-axis is referred to as a side Y2. Furthermore, the dimension of the side Y1 and the side Y2 is A1, and the dimension of the side X1 and the side X2 is A2. A convex 122*k* is provided on the wall face of the opening of the hole 128*k* so as to protrude therefrom. The convex 122*k* is equipped with a first convex 1221*k*, a second convex 1222*k*, and a third convex 1223*k*. The first convex 1221*k* is provided so as to protrude by a dimension A3 from the wall face of the opening along the side X2. The second convex 1222*k* is provided so as to protrude by the dimension A3 in the negative direction of the X-axis from the wall face of the opening along the side Y1. The third convex 1223*k* is provided so as to protrude by the dimension A3 in the positive direction of the X-axis from the wall face of the opening along the side Y2. In other words, the convex 122*k* is formed into a U-shape having two sides extending along the Y-axis direction and connected and one side extending along the X-axis direction, wherein each side is provided so as to protrude by the dimension A3 from each wall face of the opening formed along each side. It is configured that the dimension (A2) of the hole 128*k* in the X-axis direction is longer than the total of the dimension (A3) of the protruding portion of the second convex 1222*k* and the dimension (A3) of the protruding portion of the third convex 1223*k*, and that the dimension (A1) of the hole 128*k* in the Y-axis direction is longer than the dimension (A3) of the protruding portion of the first convex 1221*k*. The opening of the hole 128*k* formed as described above is roughly divided into a first space 1231*k* having the dimension A2 in the X-axis direction and a second space 1232*k* having a dimension shorter than the dimension (A2) of the first space 1231*k* by the total of the dimension (A3) of the protruding portion of the second convex 1222*k* and the dimension (A3) of the protruding portion of the third convex 1223*k*. The first space 1231*k* is a space through which the head S212*k* of the holding member S21*k* can pass, and the second space 1232*k* is a space through which the head S212*k* of the holding member S21*k* cannot pass but only the body S211*k* can pass. Furthermore, the first space 1231*k* and the second space 1232*k* are continuous to each other, and the holding member S21*k* can move in the respective spaces. As shown in FIGS. 17(*a*) and 17(*b*), an electrostatic loudspeaker 1*k* is configured by bonding the main body 11 to the upper face of the separation member 12*k*. Next, an example in which the electrostatic loudspeaker 1*k* is secured to the holding member S21*k* provided in the shield S2 is shown.

FIGS. 17(*a*) and 17(*b*) are views taken on line B-B of the electrostatic loudspeaker 1*k* equipped with the separation member 12*k* shown in FIG. 16(*a*) and views showing the electrostatic loudspeaker 1*k* secured to the shield S2. First, as shown in FIG. 17(*a*), the holding member S21*k* is inserted into the hole 128*k* of the electrostatic loudspeaker 1*k*. At this time, the head S212*k* of the holding member S21*k* is in a state of being positioned inside the hole 128*k*, and part of the body S211*k* is in a state of being positioned in the first space 1231*k*. Then, as shown in FIG. 17(*b*), in the state in which the holding member S21*k* is inserted in the hole 128*k*, the electrostatic loudspeaker 1*k* is moved in the positive direction of the Y-axis direction until the first convex 1221*k* makes contact with the body S211*k*. At this time, the head S212*k* is in a state of being positioned inside the hole 128*k*, and part of the body S211*k* is in a state of being positioned in the second space 1232*k*. Since the second space 1232*k* is in a state of being enclosed with the convex 122*k* formed into a U-shape, the head S212*k* cannot pass through the space, and only the body S211*k* can pass through the space. Hence, the movement of the electrostatic loudspeaker 1*k* is restricted by the holding member S21*k* not only in the directions around the convex 122*k* but also in the positive direction of the Z-axis direction. Since the gravitational force is applied in the positive direction of the Y-axis direction, the electrostatic loudspeaker 1*k* does not move in the negative direction of the Y-axis direction. In other words, the electrostatic loudspeaker 1*k* is restricted from moving in all the directions, thereby being secured to the shield S2. Hence, since the electrostatic loudspeaker 1*k* equipped with the separation member 12*k* shown in FIG. 16(*a*) is not required to be separately equipped with members for securing the electrostatic loudspeaker to the shield S2, the electrostatic loudspeaker can be installed easily on a place, such as a wall face, on which no object can be placed.

One or more holes may be provided in the lower face of the separation member. In addition, the shape of the hole is not limited to a rectangular shape, but the hole should only be provided with a convex that is roughly divided into a space through which the head of the holding member can pass and a space through which the head of the holding member cannot pass and through which only the body can pass.

The shield S2 is not limited to a fixed face, such as a wall face, but may be a movable face, such as a partition. In addition, the lower face of the electrostatic loudspeaker may be bonded to the shield S2 using an adhesive or an adhesive tape, for example. The shape of the electrostatic loudspeaker is not limited to a rectangular shape, but may be other shapes, such as a polygonal shape, a circular shape, or an elliptic shape.

In the above-mentioned embodiment, the electrostatic loudspeaker is secured to the shield by inserting the holding member into the hole provided in the lower face of the separation member; however, the method for securing the electrostatic loudspeaker to the shield is not limited to this method.

Figure 18:
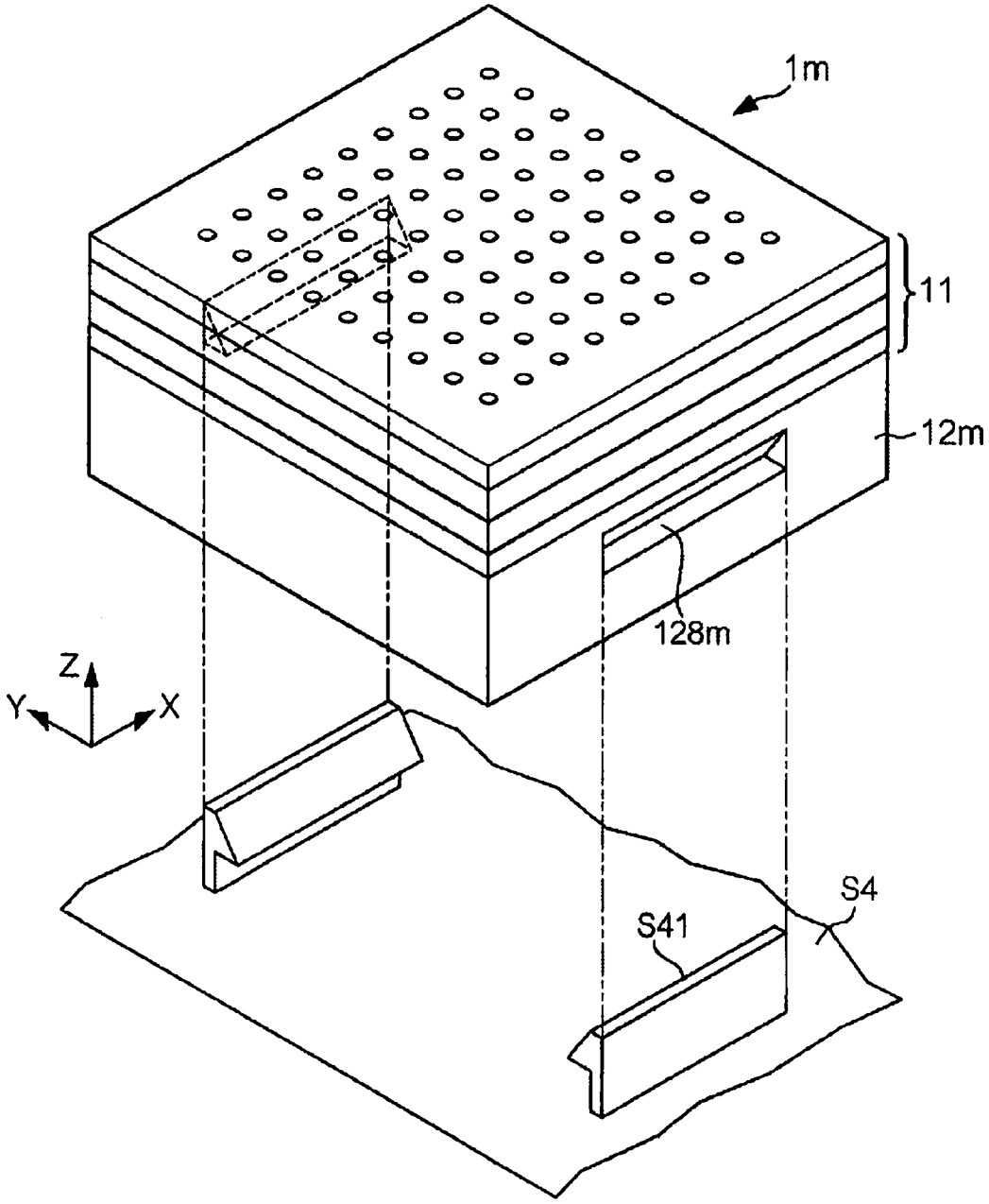
FIG. 18 is a view showing the structures of hook members and a separation member according to a modification of the present invention.

FIG. 18 is a view showing the structures of hook members and a separation member according to a modification of the present invention.

It is assumed that a shield S4 is an object, such as a floor face, a wall face, or a pillar, that can be made contact with the electrostatic loudspeaker and is an object through which an entered acoustic wave hardly passes and by which the entered acoustic wave is reflected easily. Furthermore, the shield S4 is provided with hook members S41 in the circumferential sections of a position where an electrostatic loudspeaker 1*m* is installed. In the electrostatic loudspeaker 1*m*, holes 128*m* into which the hook members S41 are inserted are provided in the circumferential faces of the separation member 12*m*. Then, the hook members S41 are inserted into the holes 128*m*, whereby it may be possible that the electrostatic loudspeaker 1*m* is secured to the shield S4.

(Modification 8)

The separation member is not limited to be made of cotton, but should only be made of a material, such as urethane foam, non-woven cloth, or glass wool, allowing air and sound to pass therethrough. Furthermore, the separation member is not limited to be formed by the method in which a material is compressed while being heated, but may be formed by providing a plurality of holes in a member formed into a plate shape, for example. The electrostatic loudspeaker may be formed of electrodes, spacers, elastic members, and a separation member having no flexibility and no elasticity.

(Modification 9)

In the above-mentioned embodiment, the vibrating member 10 is supported because one side of the vibrating member 10 is held between the lower face of the spacer 30U and the upper face of the spacer 30L. However, the main body 11 of the electrostatic loudspeaker 1 is not required to be equipped with the spacers 30. In this case, it may be possible that, for example, the vibrating member 10 is disposed between the lower face of the elastic member 40U and the upper face of the elastic member 40L, an adhesive is applied in a width of several mm from the edges in the X-axis direction and from the edges in the Y-axis direction to the inside, and the vibrating member is firmly bonded to the elastic member 40U and the elastic member 40L.

DESCRIPTION OF REFERENCE NUMERALS AND SIGNS

1 . . . electrostatic loudspeaker, 11 . . . main body, 12 . . . separation member, 131, 132, 133 . . . restraining member, 14 . . . amplifier, 10 . . . vibrating member, 20 . . . electrode, 21 . . . through-hole, 30 . . . spacer, 40 . . . elastic member, 50 . . . transformer, 60 . . . input section, 70 . . . bias supply, 100 . . . driver, S1, S2, S3, S4 . . . shield, S21*j*, S21*k* . . . holding member, S211*k* . . . body, S212*k* . . . head, S41 . . . hook member, 124*g*, 124*h* . . . base, 125*g*, 125*h* . . . protrusion, 126*g*, 126*h* . . . spacing, 127*d*, 127*e* . . . area, 128*j*, 128*k*, 128*m* . . . hole, 122*k* . . . convex, 1221*k* . . . first convex, 1222*k* . . . second convex, 1223*k* . . . third convex, 1231*k* . . . first space, 1232*k* . . . second space

The invention claimed is:

1. An electrostatic loudspeaker comprising:

a first electrode having acoustic transmission property;

a second electrode having acoustic transmission property disposed opposing the first electrode;

a vibrating member having conductibility disposed between the first electrode and the second electrode;

a first elastic member having elasticity, insulation property, and acoustic transmission property disposed between the vibrating member and the first electrode;

a second elastic member having elasticity, insulation property, and acoustic transmission property disposed between the vibrating member and the second electrode; and a first separation member having insulation property and acoustic transmission property disposed on an opposite side of a face of the first electrode, which is opposing the first elastic member, wherein the first separation member and the first electrode have substantially the same shape in a plan view.

2. The electrostatic loudspeaker according to claim 1, further comprising:

a second separation member having insulation property and acoustic transmission property, and disposed on an opposite side of a face of the second electrode, which is opposing the second elastic member, wherein the second separation member and the second electrode have substantially the same shape in the plan view.

3. The electrostatic loudspeaker according to claim 2, wherein the first separation member has a hole opening from an inside of the first separation member toward a face on an opposite side of a face of the first separation member, which is opposing the first electrode.

4. The electrostatic loudspeaker according to claim 1, wherein the first separation member has a hole opening from an inside of the first separation member toward a face on an opposite side of a face of the first separation member, which is opposing the first electrode.

5. The electrostatic loudspeaker according to claim 4, further comprising a holding member inserted into the hole.

6. The electrostatic loudspeaker according to claim 1, wherein the first separation member has a hole in a circumferential face thereof.

7. The electrostatic loudspeaker according to claim 6, further comprising a hook member inserted into the hole.

8. The electrostatic loudspeaker according to claim 1, wherein the first separation member has elasticity.

9. The electrostatic loudspeaker according to claim 1, further comprising:

a main body having at least the first electrode, the second electrode, the vibrating member, the first elastic member, and the second elastic member; and a restraining member, wherein the first separation member is integrated with the main body using the restraining member into one body.

10. The electrostatic loudspeaker according to claim 9, wherein the restraining member has a belt shape.

11. The electrostatic loudspeaker according to claim 9, wherein the restraining member is a member for covering the first separation member and the main body.

12. The electrostatic loudspeaker according to claim 1, further comprising:

a main body having at least the first electrode, the second electrode, the vibrating member, the first elastic member, and the second elastic member, wherein the first separation member has one face having a convex shape and in contact with the first electrode, and wherein the main body is provided on the one face.

13. The electrostatic loudspeaker according to claim 1, further comprising:

a main body having at least the first electrode, the second electrode, the vibrating member, the first elastic member, and the second elastic member, wherein the first separation member has one face having a concave shape and in contact with the first electrode, and wherein the main body has at least the first electrode, the second electrode, the vibrating member, the first elastic member, and the second elastic member provided on the one face.

14. The electrostatic loudspeaker according to claim 1, further comprising:

a main body having at least the first electrode, the second electrode, the vibrating member, the first elastic member, and the second elastic member, wherein the first separation member has one face formed into a curved shape and an opposite face on an opposite side of the one face, and wherein the main body is provided on the opposite face.

15. The electrostatic loudspeaker according to claim 1, wherein the first separation member has a base and a plurality of protrusions provided on one face of the base.

16. The electrostatic loudspeaker according to claim 1, wherein the first separation member has a plurality of spaces having a predetermined shape joined together.

17. The electrostatic loudspeaker according to claim 16, wherein the predetermined shape is a hexagonal shape.

18. A speaker system comprising:

a loudspeaker main body including:

a first electrode having acoustic transmission property;

a second electrode having acoustic transmission property disposed opposing the first electrode;

a vibrating member having conductibility disposed between the first electrode and the second electrode;

a first elastic member having elasticity, insulation property, and acoustic transmission property disposed between the vibrating member and the first electrode; and a second elastic member having elasticity, insulation property, and acoustic transmission property disposed between the vibrating member and the second electrode; and a separation member having insulation property and acoustic transmission property disposed on an opposite side of a face of the first electrode which is opposing the first elastic member, wherein the first separation member and the first electrode have substantially the same shape in a plan view.

19. A separation member mounted on a loudspeaker main body having:

a first electrode having acoustic transmission property, a second electrode having acoustic transmission property disposed opposing the first electrode;

a vibrating member having conductibility disposed between the first electrode and the second electrode;

a first elastic member having elasticity, insulation property, and acoustic transmission property disposed between the vibrating member and the first electrode; and a second elastic member having elasticity, insulation property, and acoustic transmission property disposed between the vibrating member and the second electrode, wherein the separation member has insulation property and acoustic transmission property disposed on an opposite side of a face of the first electrode of the loudspeaker's main body, which is opposing the first elastic member, wherein the first separation member and the first electrode have substantially the same shape in a plan view.

* * * * *